US009943150B2

(12) United States Patent
Morrow

(10) Patent No.: US 9,943,150 B2
(45) Date of Patent: Apr. 17, 2018

(54) LUNCH TOTE FOR STORING FOOD WHICH IS CONVERTIBLE INTO A SERVING TRAY

(71) Applicant: Clean Pack, LLC, Black Creek, WI (US)

(72) Inventor: Grace Elizabeth Morrow, Black Creek, WI (US)

(73) Assignee: Clean Pack, LLC, Black Creek, WI (US)

( * ) Notice: Subject to any disclaimer, the term of this patent is extended or adjusted under 35 U.S.C. 154(b) by 0 days.

(21) Appl. No.: 15/710,499

(22) Filed: Sep. 20, 2017

(65) Prior Publication Data

US 2018/0008023 A1 Jan. 11, 2018

Related U.S. Application Data

(63) Continuation-in-part of application No. 15/368,762, filed on Dec. 5, 2016.
(Continued)

(51) Int. Cl.

| | |
|---|---|
| ***B65D 30/02*** | (2006.01) |
| ***A45C 9/00*** | (2006.01) |
| ***A45C 13/02*** | (2006.01) |
| ***A45C 13/00*** | (2006.01) |
| ***A45C 13/10*** | (2006.01) |
| ***A47G 23/06*** | (2006.01) |

(Continued)

(52) U.S. Cl.

CPC ..... *A45C 9/00* (2013.01); *A45C 11/20* (2013.01); *A45C 13/005* (2013.01); *A45C 13/02* (2013.01); *A45C 13/103* (2013.01); *A45C 13/1076* (2013.01); *A47G 23/06* (2013.01); *B65D 81/18* (2013.01); *B65D 81/3813* (2013.01); *F25D 3/08* (2013.01); *A45C 2013/1015* (2013.01); *F25D 2303/0843* (2013.01); *F25D 2303/0845* (2013.01); *F25D 2303/08221* (2013.01); *F25D 2303/08222* (2013.01)

(58) Field of Classification Search

USPC ..... 206/541, 542, 543, 545, 546, 547, 548, 206/549; 190/114

See application file for complete search history.

(56) References Cited

U.S. PATENT DOCUMENTS

| | | |
|---|---|---|
| 2,563,933 A | 8/1951 | Hipps et al. |
| 4,429,793 A | 2/1984 | Ehmann |

(Continued)

*Primary Examiner* — Jacob K Ackun

(74) *Attorney, Agent, or Firm* — Thomas J. Connelly; Northwind IP Law, S.C.

(57) ABSTRACT

A lunch tote for storing food is disclosed which includes an outer cover having a perimeter and first and second ends. A sidewall extends upward from the perimeter and has a distal edge. A liner having an outer perimeter is attached to the outer cover to form a pocket having an opening formed therein. A cooling mechanism is positioned in the pocket and is enclosed in a moisture-absorbing/insulating cover. A first insulating layer is positioned between the outer cover and the liner. An intermediate layer is positioned above the first insulating layer. A closure mechanism is secured to a portion of the distal edge. The closure mechanism is movable from a closed position, wherein the lunch tote is a closed container, to an open position, wherein the entire lunch tote is convertible into a serving tray. The lunch tote further includes a pair of handles.

20 Claims, 6 Drawing Sheets

Related U.S. Application Data

(60) Provisional application No. 62/263,140, filed on Dec. 4, 2015.

(51) Int. Cl.

| | |
|---|---|
| ***B65D 81/38*** | (2006.01) |
| ***B65D 81/18*** | (2006.01) |
| ***F25D 3/08*** | (2006.01) |
| ***A45C 11/20*** | (2006.01) |

(56) References Cited

U.S. PATENT DOCUMENTS

| | | | | |
|---|---|---|---|---|
| 4,848,543 | A | 7/1989 | Doboze | |
| 5,743,405 | A | 4/1998 | Reid | |
| 5,855,274 | A | 1/1999 | Piao | |
| 5,865,314 | A | 2/1999 | Jacober | |
| 6,935,133 | B2 | 8/2005 | Keeter et al. | |
| 7,919,163 | B2 | 4/2011 | Romero | |
| D682,636 | S | 5/2013 | Boroski | |
| 2003/0006164 | A1 | 1/2003 | Mateus et al. | |
| 2003/0221924 | A1* | 12/2003 | Tong | A45C 7/0036 190/107 |
| 2004/0144783 | A1* | 7/2004 | Anderson | A45C 11/20 220/23.87 |
| 2005/0039260 | A1 | 2/2005 | Tyler | |
| 2005/0056048 | A1 | 3/2005 | Fuchs | |
| 2005/0067246 | A1 | 3/2005 | Teicher et al. | |
| 2005/0103044 | A1 | 5/2005 | Mogil et al. | |
| 2009/0282860 | A1 | 11/2009 | Shaw | |
| 2010/0065465 | A1 | 3/2010 | Delgado | |
| 2010/0089929 | A1 | 4/2010 | Ramundi | |
| 2010/0270317 | A1* | 10/2010 | Kieling | A45C 3/001 220/592.25 |
| 2011/0240722 | A1 | 10/2011 | Stromme | |
| 2013/0068776 | A1* | 3/2013 | Patterson | A45F 3/46 220/592.01 |
| 2013/0233741 | A1 | 9/2013 | Caruth | |
| 2014/0248003 | A1* | 9/2014 | Mogil | A45C 3/001 383/3 |
| 2015/0001126 | A1 | 1/2015 | Floyd-Vester et al. | |
| 2016/0029762 | A1 | 2/2016 | James, Jr. | |
| 2016/0101924 | A1 | 4/2016 | Mitchell et al. | |
| 2016/0107816 | A1* | 4/2016 | Larpenteur | A47J 47/14 220/592.01 |
| 2017/0156463 | A1 | 7/2017 | Morrow | |

* cited by examiner

LUNCH TOTE FOR STORING FOOD WHICH IS CONVERTIBLE INTO A SERVING TRAY

CROSS-REFERENCE TO RELATED APPLICATION

This application is a Continuation-In-Part of and claims priority from pending U.S. Non-provisional patent application Ser. No. 15/368,762, filed Dec. 5, 2016, which in turn claims priority from expired U.S. provisional application No. 62/263,140, filed Dec. 4, 2015, both of which are incorporated herein by reference.

FIELD OF THE INVENTION

This invention relates to a lunch tote for storing food which is convertible into a serving tray and which can contain a cooling mechanism for keeping the food cool and fresh.

BACKGROUND OF THE INVENTION

Various styles and types of lunch totes are commercially available today. Lunch totes are carrying devices designed to temporarily transport and store food items, especially lunch food. Lunch containers, lunch boxes, lunch pails or lunch kits are various terms used to describe similar food storage containers that can be easily transported. School children, working adults, fishermen, sport enthusiasts, people on a picnic or outing, etc. normally pack a lunch tote. A lunch tote is usually packed with food items for a single individual. Common food items include a sandwich, a thermos or a drink container, such as a bottle of water, a can containing pop or soda, a juice box, one or more kinds of fruit, a container housing a vegetable, and snacks, such as chips, cookies, candy, etc. One disadvantage with most lunch totes today is that they are formed from a rigid material. Most lunch totes are formed out of a thin metal, aluminum or plastic and are not designed to be washed in a conventional home washing machine. Because such lunch totes cannot be thoroughly cleaned, odor causing bacteria can build up in the seams and crevices. A second disadvantage is that most lunch totes are not machine dryable. Their construction does not permit them to be placed in a conventional home dryer and be dried after being machine washed.

Some lunch totes are constructed from a washable fabric. However, these forms of lunch containers suffer from some other shortfalls. Some are very flexible and therefore they are not rigid enough to stand upright by themselves or rigid enough to keep the various food items from contacting one another. If a sandwich is contacted by a can of soda, the sandwich is most likely going to get squished. Likewise, if an apple or peach is allowed to bang against a thermos, the fruit is sure to get bruised. Another disadvantage is that many of the flexible lunch containers are not designed to accommodate an ice cube pack or a chemical ice pack. Normally, the ice pack is inserted into the lunch tote first and then the food is introduced or the ice pack is placed in last, after the food items have been placed into the lunch tote. Either process causes the food items located adjacent to the ice pack to stay cold while the food items located away from the ice pack get warm. In addition, as the ice pack thaws, condensation forms, causing the surrounding food and the inside of the lunch tote to become wet. Another disadvantage is that there is no way to retain the ice pack in a desired position while the lunch tote is being carried or stored in a locker. This means that some of the food items may start to spoil before they are consumed.

Still another disadvantage of most lunch totes is that they do not provide a serving tray which can be used to keep the food items clean. Some lunch totes do provide a flat mat to eat on but this allows the food to slide or roll off onto a public use surface. If the food items are removed from the lunch container and placed on a dirty tabletop, the food items can become contaminated. Many times, there is no clean surface present on which to place the food items removed from the lunch container. Many public use surfaces, such as a cafeteria table or picnic table, do not provide a clean surface from which to consume one's lunch. As can be seen, there is a need for an improved lunch tote that provides a safe and sanitary eating surface.

Now a lunch tote has been invented which satisfies the above drawbacks with conventional lunch containers.

SUMMARY OF THE INVENTION

Briefly, this invention relates to a lunch tote for storing food. The lunch tote includes an outer cover having an interior surface, an exterior surface, and a perimeter. The outer cover also has a first end and a second end. The lunch tote also has a sidewall extending upward from the perimeter when the lunch tote is in an open orientation. The sidewall has a distal edge. A liner is also present which has an outer perimeter. A portion of the liner is attached to the interior surface of the outer cover to form a pocket. A portion of the outer perimeter is free from the interior surface to form an opening into the pocket. The pocket is sized and shaped to receive a cooling mechanism. An intermediate layer is positioned below the cooling mechanism. A first insulating layer is positioned between the interior surface and the intermediate layer. The lunch tote also has a closure mechanism secured to a major portion of the distal edge of the sidewall. The closure mechanism is movable from a closed orientation, wherein the lunch tote is a closed container, to an open orientation, wherein the entire lunch tote is convertible into a serving tray. Lastly, the lunch tote has a pair of handles extending outward from the outer cover. One of the pair of handles is located approximate the first end, and a second of the pair of handles is located approximate the second end.

In another embodiment, a lunch tote for storing food is taught which includes an outer cover having an interior surface, an exterior surface, and a perimeter. The outer cover also has a first end and a second end. The lunch tote further has a sidewall extending upward from the perimeter when the lunch tote is in an open orientation. The sidewall has a distal edge and also contains first and second inwardly projecting portions. A liner is also present which has an outer perimeter. A portion of the liner is attached to the interior surface of the outer cover to form a pocket. A portion of the outer perimeter is free from the interior surface to form an opening into the pocket. The pocket is sized and shaped to receive a cooling mechanism. The cooling mechanism has a first portion, a second portion, and a third portion, and the second portion has a rigid member secured thereto. This cooling mechanism is enclosed in a moisture-absorbing insulating layer. An intermediate layer is positioned below the cooling mechanism. A first insulating layer is positioned between the interior surface and the intermediate layer. The lunch tote also has a closure mechanism secured to a major portion of the distal edge of the sidewall. The closure mechanism is movable from a closed orientation, wherein the lunch tote is a closed container, to an open orientation, wherein the entire lunch tote is convertible into a serving tray. The closure mechanism is spaced apart from the first inwardly projecting portion and terminates on either side of the second inwardly projecting portion. Lastly, the lunch tote has a pair of handles extending outward from the outer cover. One of the pair of handles is located approximate the first end, and a second of the pair of handles is located approximate the second end.

In a third embodiment, a lunch tote for storing food is taught which includes an outer cover having an interior surface, an exterior surface, and a perimeter. The outer cover also has a first end and a second end. The lunch tote also has a sidewall extending upward from the perimeter when the lunch tote is in an open orientation. The sidewall has a distal edge and also contains first and second inwardly projecting portions. A liner is also present which has an outer perimeter. A portion of the liner is attached to the interior surface of the outer cover to form a pocket. A portion of the outer perimeter is free from the interior surface to form an opening into the pocket. The pocket is sized and shaped to receive a cooling mechanism. The cooling mechanism has a first portion, a second portion, and a third portion, and the second portion contains a rigid member. This cooling mechanism is enclosed in a moisture-absorbing insulating layer. An intermediate layer is positioned below the cooling mechanism. A first insulating layer is positioned between the interior surface and the intermediate layer. The liner also has an inner surface with a sleeve formed thereon, and also has at least two spaced apart loops, aligned along a common centerline, for securing one or more articles therebetween. The lunch tote also has a closure mechanism secured to a major portion of the distal edge of the sidewall. The closure mechanism is movable from a closed orientation, wherein the lunch tote is a closed container, to an open orientation, wherein the entire lunch tote is convertible into a serving tray. The closure mechanism is spaced apart from the first inwardly projecting portion and terminates on either side of the second inwardly projecting portion. Lastly, the lunch tote has a pair of handles extending outward from the outer cover. One of the pair of handles is located approximate the first end, and a second of the pair of handles is located approximate the second end.

The general object of this invention is to provide a lunch tote which is convertible into a serving tray. A more specific object of this invention is to provide a lunch tote which has a pocket for securing a cooling mechanism, and which provides an insulating cover for the cooling mechanism which keeps the food in the lunch tote dry.

Another object of this invention is to provide a lunch tote which is formed from a machine washable fabric.

A further object of this invention is to provide a lunch tote which is formed from a flexible fabric and which includes a rigid member so that it can stand upright by itself.

Still another object of this invention is to provide a lunch tote which includes a sleeve and a pair of loops for securing various items within the lunch tote.

Still further, an object of this invention is to provide a method of using the lunch tote.

Other objects and advantages of the present invention will become more apparent to those skilled in the art in view of the following description and the accompanying drawings.

DETAILED DESCRIPTION OF THE INVENTION

Figure 1:
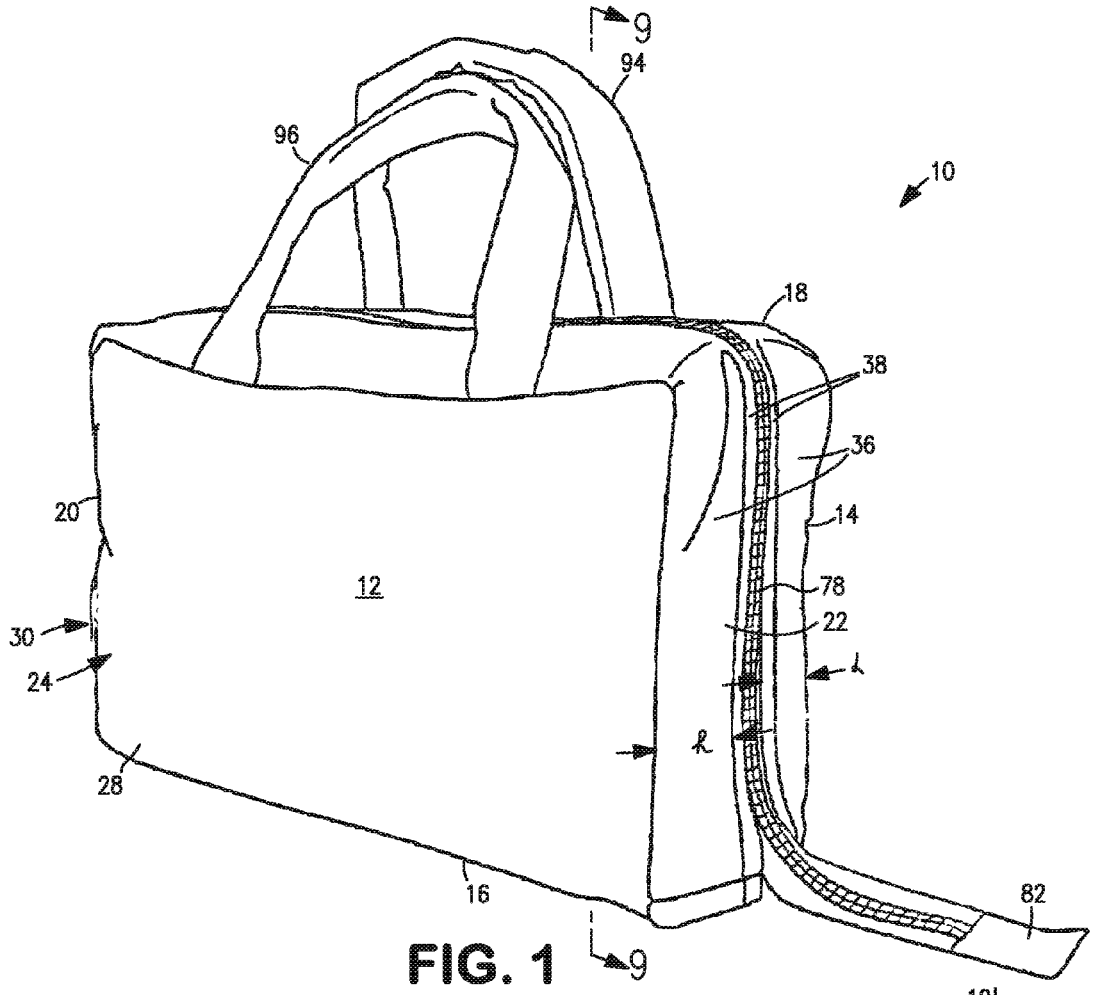
FIG. 1 is a perspective view of a lunch tote in a closed orientation, wherein said lunch tote is a closed container.

Referring to FIG. 1, a lunch tote 10 for storing food is shown in a closed position. In this closed position, the lunch tote 10 is capable of housing or containing a number of food items, a thermos or a drink container, eating utensils, such as a knife, fork and spoon, napkins, a bottle opener, etc. The lunch tote 10 is depicted as having a generally rectangular configuration, although the lunch tote 10 could be manufactured in any desired geometrical shape. The lunch tote 10 has a front 12, a back 14, a bottom 16, a top 18, and a pair of sides 20 and 22. The lunch tote 10 includes an outer cover 24. The outer cover 24 is formed from a relatively soft and flexible material which can be sewn or stitched. For example, the outer cover 24 can be formed from a cloth fabric. The cloth fabric can be produced by knitting, weaving or felting fibers, or by any other method known to those skilled in the art. The outer cover 24 can also be formed from any kind of woven or non-woven fabric. The outer cover 24 can be formed from natural fibers or synthetic fibers. By "synthetic" it is meant produced by synthesis, not of natural origin. When the outer cover 24 is formed from natural fibers, it can be made from cotton or various blends of cotton. When the outer cover 24 is made from synthetic fibers, it can be constructed from polyester, or blends thereof. The outer cover 24 is formed from a fabric which is machine washable. Desirably, the outer cover 24 can be washed in a home washing machine. The outer cover 24 is also machine dryable, such as in a home dryer. Desirably, the outer cover 24 is both machine washable and machine dryable in conventional washers and dryers.

Referring now to FIGS. 1, 2, 11 and 12, the lunch tote 10 is shown in an open position wherein it is convertible into a serving tray 10'. In this view, the outer cover 24 has a longitudinal central axis X-X, a vertical central axis Y-Y, and a transverse central axis Z-Z, see FIG. 2. The outer cover 24 also has an interior surface 26, see FIGS. 11 and 12, and an exterior surface 28. The outer cover 24 further has a perimeter 30, see FIG. 1, and a first end 32 and a second end 34, see FIGS. 2 and 11. The first and second ends, 32 and 34 respectively, are aligned opposed to one another along the longitudinal central axis X-X.

Figure 2:
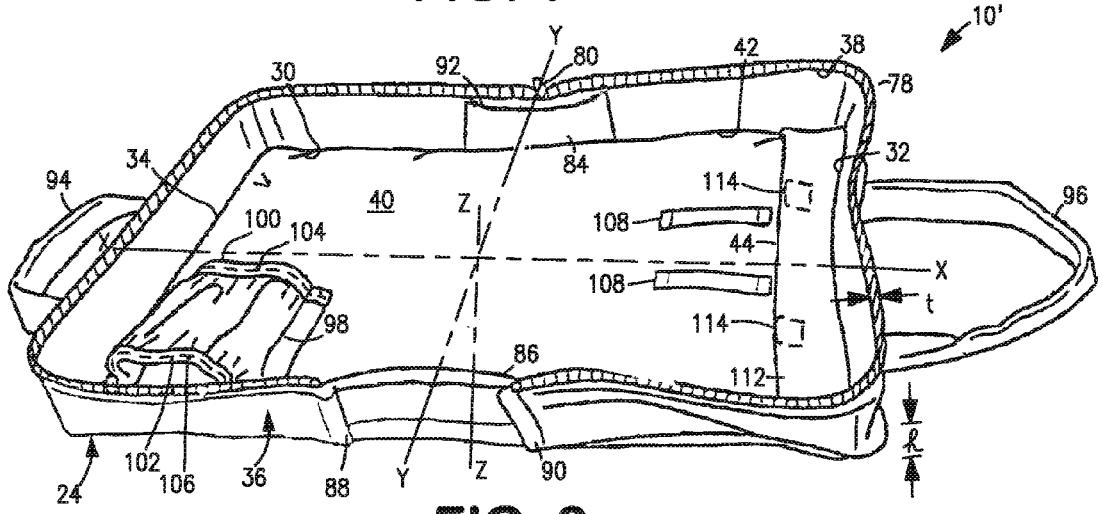
FIG. 2 is a perspective view of the lunch tote depicted in FIG. 1, wherein the entire lunch tote is convertible into a serving tray.
Figure 3:
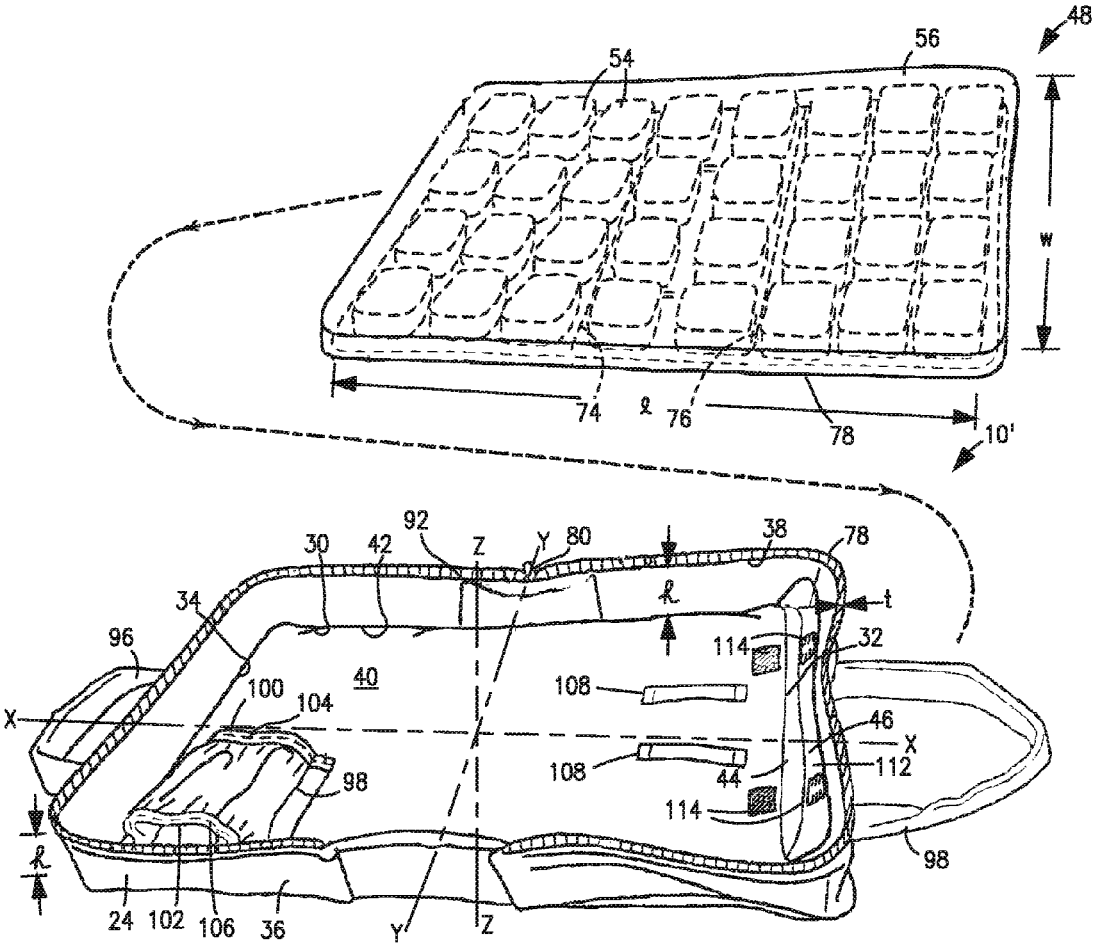
FIG. 3 is a perspective view of the lunch tote depicted in FIG. 2 showing how a cooling mechanism can be inserted into a designated pocket.

Referring now to FIGS. 1-3, the lunch tote 10 also has a sidewall 36 which extends upward from the perimeter 30 of the outer cover 24 when the lunch tote 10 is in an open orientation. The sidewall 36 can be attached or secured to the outer cover 24 by sewing, stitching, by using an adhesive, by ultrasonic bonding, or in some other fashion known to those skilled in the art. Desirably, the sidewall 36 is attached to the outer cover 24 by sewing or stitching. The sidewall 36 is formed from a relatively soft and flexible material. For example, the sidewall 36 can be formed from a cloth fabric. The cloth fabric can be produced by knitting, weaving or felting fibers, or by any other method known to those skilled in the art. The sidewall 36 can also be formed from any kind of woven or non-woven fabric. The sidewall 36 can be formed from natural fibers or synthetic fibers. The sidewall 36 can be constructed of the same material which forms the outer cover 24. Desirably, the sidewall 36 is formed from the same material as the outer cover 24. The sidewall 36 is machine washable. More desirably, the sidewall 36 is both machine washable and machine dryable.

Referring again to FIGS. 2 and 3, the sidewall 36 has a distal edge 38. The sidewall 36 can vary in height h and thickness t. The height h of the sidewall 36 is measured from the interior surface 26 of the outer cover 24 to the distal edge 38. The height h can vary in dimension. Desirably, the height h of the sidewall 36 ranges from between about 0.5 inches to about 3 inches. More desirably, the height h of the sidewall 36 ranges from between about 0.75 inches to about 2.5 inches. Even more desirably, the height h of the sidewall 36 ranges from between about 1 inch to about 2 inches. Even more desirably, the height h of the sidewall 36 is at least 1.5 inches. Most desirably, the height h of the sidewall 36 is at least 1.75 inches. The function of the sidewall 36 is to contain any food items, thermos or drinking container, eating utensils, napkins, etc. when the lunch tote 10 is in an open orientation and acting as a serving tray 10'. The sidewall 36 prevents the food items from moving off of the interior surface 26 of the lunch tote 10 and becoming contaminated.

The thickness t of the sidewall 26 can vary in dimension. The sidewall 36 can contain one, two or more layers of material. In addition, the sidewall 36 can optionally include an insulating layer, if desired. The thickness t of the sidewall 36 can range from between about 0.05 inches to 0.25 inches. Desirably, the thickness t of the sidewall 36 ranges from between about 0.06 inches to 0.2 inches. Most desirably, the thickness t of the sidewall 36 is less than about 0.2 inches.

Referring to FIGS. 2, 3, 11 and 12, the lunch tote 10 further includes a liner 40 having an outer perimeter 42. The liner 40 can be attached or secured to the outer cover 24 and/or the sidewall 36 by sewing, stitching, by using an adhesive, by using heat, by using pressure, by using a combination of heat and pressure, by ultrasonic bonding, or in some other fashion known to those skilled in the art. Desirably, the liner 40 is attached to the outer cover 24 by sewing or stitching. The liner 40 can also be attached to both the outer cover 24 and to the sidewall 36, if desired, by sewing or stitching.

The liner 40 is formed from a relatively soft and flexible material. For example, the liner 40 can be formed from a cloth fabric. The cloth fabric can be produced by knitting, weaving or felting fibers, or by any other method known to those skilled in the art. The liner 40 can also be formed from any kind of woven or non-woven fabric. The liner 40 can be formed from natural fibers or synthetic fibers. The liner 40 can be made of the same material as the outer cover 24 or from a different material. Desirably, the liner 40 is made from the same material as was used to construct both the outer cover 24 and the sidewall 36. Desirably, the liner 40 is machine washable. More desirably, the liner 40 is both machine washable and machine dryable. The function of the liner 40 is to present a clean, non-contaminated and/or sanitized surface against which the food items, thermos or drinking container, eating utensils, napkin, etc. will make contact.

Figure 4:
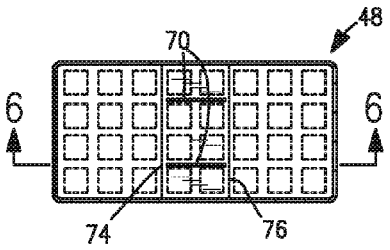
FIG. 4 is a bottom view of a cooling mechanism.
Figure 11:
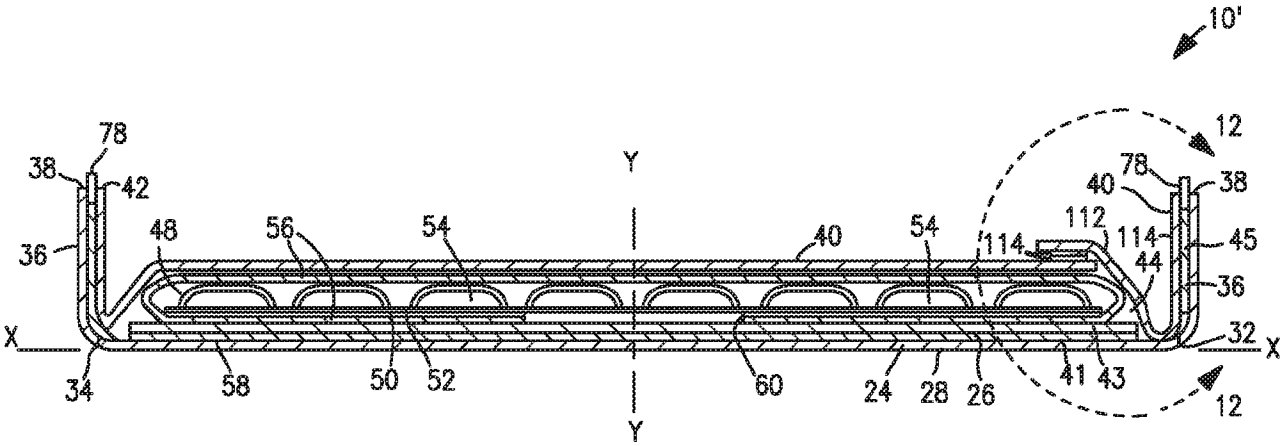
FIG. 11 is a cross-sectional view of the lunch tote taken along line 11-11 of FIG. 7.
Figure 12:
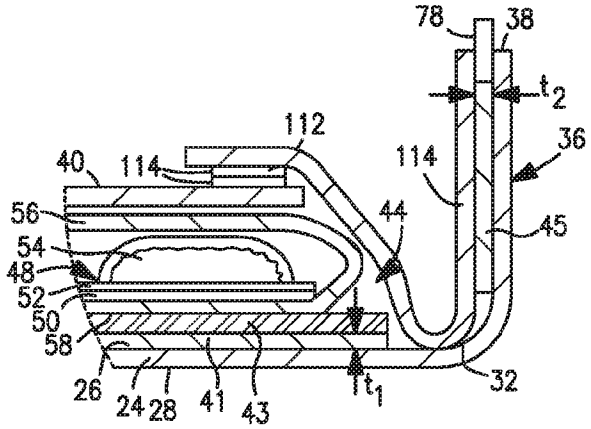
FIG. 12 is an enlarged cross-sectional view of the lunch tote taken along line 12-12 of FIG. 11.

Still referring to FIG. 3, a substantial portion of the liner 40 is attached or secured to the interior surface 26 of the outer cover 24 to form a pocket 44, see FIGS. 11 and 12. A portion of the outer perimeter 42 of the liner 40 is free from (not attached to) the interior surface 26 of the outer cover 24 to form an opening 46 into the pocket 44, see FIG. 3. The pocket 44 is capable of receiving a cooling mechanism 48, see FIGS. 4 and 5.

Referring now to FIGS. 11 and 12, the lunch tote further includes a first insulating layer 41, an intermediate layer 43 and a second insulating layer 45. The first insulating layer 41 is positioned between the interior surface 26 of the outer cover 24 and the intermediate layer 43. The first insulating layer 41 extends over a portion of the surface of the outer cover 24. Desirably, the first insulating layer 41 extends over a substantial portion of the surface of the outer cover 24. The intermediate layer 43 is positioned above the insulating layer 41. The intermediate layer 43 functions to keep the first insulating layer 41 intact. The second insulating layer 45 is positioned in the sidewall 36. The second insulating layer 45 is separate and distinct from the first insulating layer 41. The first and second insulating layers 41 and 45 can be formed from various insulating materials known to those skilled in the art. For example, each of the first and second insulating layers, 41 and 45 respectively, could be formed from Insul-Bright®.

The first insulating layer 41 has a thickness $t_1$ which can vary in dimension. The thickness $t_1$ of the insulating layer 41 is at least about 0.015 inches. Desirably, the thickness $t_1$ of the first insulating layer 41 is at least about 0.1 inches. Most desirably, the thickness $t_1$ of the first insulating layer 41 is at least about 0.125 inches. The first insulating layer 41 functions to prevent the escape of cool air from the inside of the lunch tote 10 when the lunch tote 10 is in a closed position and contains a frozen cooling mechanism 48.

The intermediate layer 43 can be formed from various materials. Desirably, the intermediate layer 43 is formed from a cloth material.

The second insulating layer 45 has a thickness $t_2$which can vary in dimension. The thickness $t_2$ of the second insulating layer 45 can be equal to, be less than, or be greater than the thickness $t_1$ of the first insulating layer 41. The thickness $t_2$ of the second insulating layer 45 is at least about 0.015 inches. Desirably, the thickness $t_2$ of the second insulating layer 45 is at least about 0.1 inches. Most desirably, the thickness $t_2$ of the second insulating layer 45 is at least about 0.125 inches. The second insulating layer 45 functions to prevent the escape of cool air from the inside of the lunch tote 10 when the lunch tote 10 is in a closed position and contains a frozen cooling mechanism 48.

Figure 5:
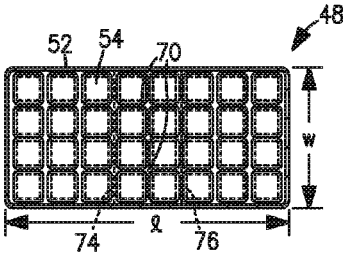
FIG. 5 is a top view of a cooling mechanism.
Figure 6:
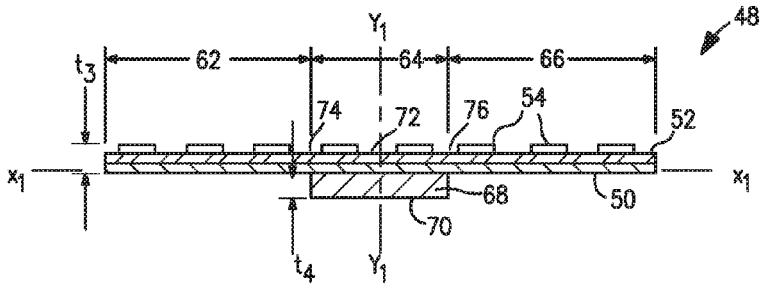
FIG. 6 is a cross-section view of a cooling mechanism taken along line 6-6 of FIG. 4 showing a rigid member secured thereto.
Figure 7:
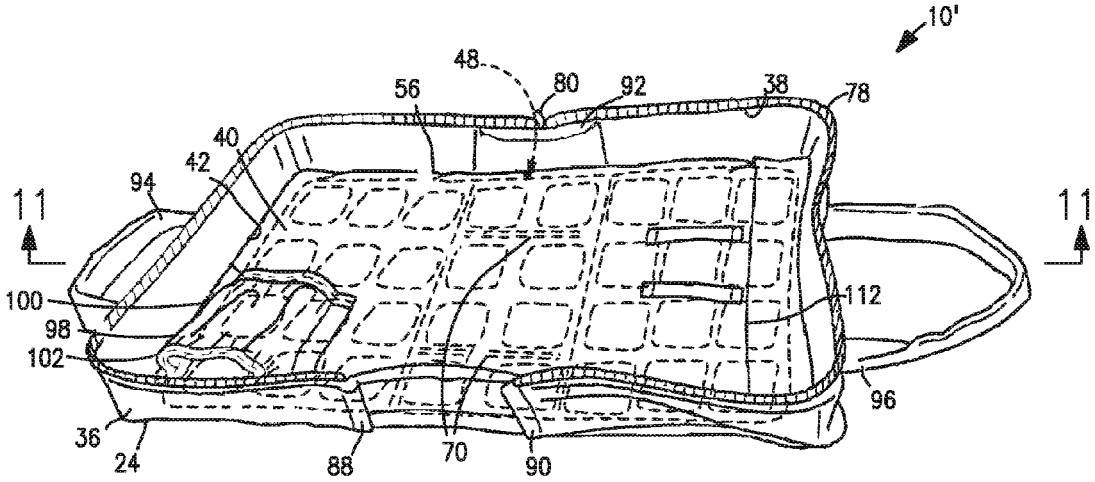
FIG. 7 is a perspective view of the lunch tote in an open orientation illustrating the cooling mechanism positioned within the perimeter of the outer cover.
Figure 8:
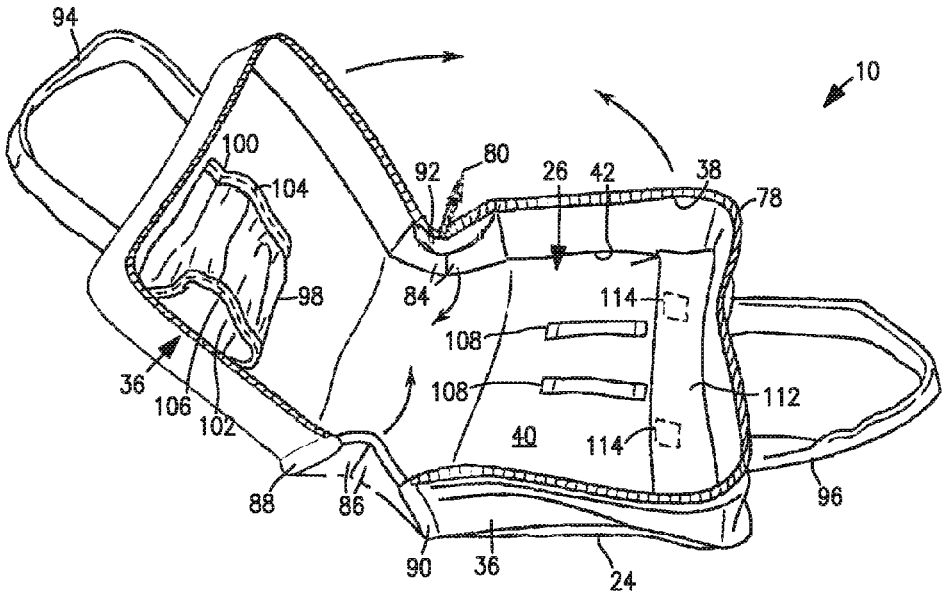
FIG. 8 is a perspective view of the lunch tote transitioning between the open and closed orientations.

Referring now to FIGS. 3, 5 and 6, the lunch tote 10 also includes a cooling mechanism 48 which can vary in size, shape and configuration. For example, the cooling mechanism 48 could be a flexible freeze pack, an ice pack, etc. The cooling mechanism 48 can have any desired geometrical shape. A rectangular or square configuration works well. The dimensions of the cooling mechanism 48 can vary. When the cooling mechanism 48 has a rectangular shape, it has a length l, a width w and a thickness $t_3$. The length l of the cooling mechanism 48 can range from between about 10 inches to about 20, and the width w can range from between about 4 inches to about 8 inches. The thickness $t_3$ of the cooling mechanism 48, see FIG. 6, can be about 1.5 inches or less. Desirably, for a cooling mechanism 48 having a rectangular shape, the length l can range from between about 12 inches to about 16 inches, the width w can range from between about 5 inches to about 7 inches, and the thickness $t_3$ can be about 1.25 inches or less. More desirably, for a cooling mechanism 48 having a rectangular shape, the length l can be about 15 inches, the width w can be about 6 inches, and the thickness $t_3$ can be about 1 inch or less. The function of the cooling mechanism 48 is to keep the food items, thermos and/or drink container cool. The cooling mechanism 48 is sized and shaped to extend over the front 12, the back 14 and the bottom 16 of the lunch tote 10. By having the cooling mechanism 48 extend over this large surface area, one can be assured that the food items and the thermos and/or drink container, which are stored in the lunch tote 10, will remain cool for an extended period of time.

Referring now to FIGS. 3-6, the cooling mechanism 48 can be an ice cube pack, an ice pack, a chemical ice pack, a pouch filled with ice cubes, etc. The cooling mechanism 48 is depicted in the form of a rectangular ice pack having a bottom layer 50 joined to a top layer 52. It should be noted that the cooling mechanism 48 can have any desired geometrical shape or configuration. Likewise, the overall dimensions of the cooling mechanism 48 can vary. A cooling mechanism 48 having a rectangular shape is easy to insert into the pocket 44 of the lunch tote 10. One or more cavities 54 can be formed in either the bottom layer 50 or in the top layer 52. Alternatively, the one or more cavities 54 could be formed in both of the bottom and top layers, 50 and 52 respectively. Desirably, the one or more cavities 54 are formed in only one of the bottom or top layers, 50 and 52 respectively. More desirably, a plurality of cavities 54 are formed in the top layer 52. The one or more cavities 54 can be filled with a liquid (not shown). The liquid should be capable of being frozen into a solid. The liquid should change from a liquid to a solid once it is frozen. The liquid can be water, a water-chemical mixture, or a chemical known to those skilled in the art which can be frozen.

The one or more cavities 54 can be filled with a liquid which is retained between the bottom and top layers, 50 and 52 respectively. The bottom and top layers, 50 and 52 respectively, can be sealed using heat, pressure, a combination of heat and pressure, ultrasonic bonding, adhesive, or any other technique known to those skilled in the art. Desirably, the cooling mechanism 48 is an ice pack as described below. Alternatively, the cooling mechanism 48 can contain a plurality of ice cubes.

Referring to FIG. 6, the bottom layer 50 and the top layer 52 of the cooling mechanism 48 can be formed from various materials. Desirably, the bottom layer 50 and the top layer 52 are formed from the same or a similar material. The bottom and/or top layers, 50 and 52 respectively, can be formed from a plastic or thermoplastic material, or from some other material known to those skilled in the art. The plastic or thermoplastic material can be formed as a film. The plastic or thermoplastic material can be formed from polypropylene, polyethylene, a combination of polypropylene and polyethylene, or be made from some other polyolefin known to those skilled in the art. For example, the bottom layer 50 can be a clear, planar plastic layer, and the top layer 52 can be a clear, plastic layer containing one or more cavities 54. It is desirable to have a plurality of cavities 54 formed in the top layer 52. The size and shape of the one or more cavities 54 can vary. If only one cavity 54 is present, it can have a larger size relative to the use of a plurality of smaller sized cavities 54. When a plurality of cavities 54 is present, the size of each cavity 54 can be approximately equivalent to the size of an ordinary ice cube. Each of the plurality of cavities 54 can have a square, rectangular or some other geometrical shape. A cavity 54 having a square or rectangular shape works well. A square shaped cavity 54 having sides ranging from about 1 inch to about 2 inches works well in the lunch tote 10. Likewise, a rectangle shaped cavity 54 having a length of about 1.75 inches and a width of about 1.25 inches also works well especially when the cooling mechanism 48 has a rectangular shape measuring about 7 inches by about 15 inches.

The cooling mechanism 48 is a commercially produced product.

Referring again to FIGS. 3, 11 and 12, the lunch tote 10 also includes a moisture-absorbing/insulating cover 56. The moisture-absorbing/insulating cover 56 can be formed from various materials. The moisture-absorbing/insulating cover 56 can be formed from a cloth fabric, such as flannel. By 'flannel" it is meant a soft woven cloth of cotton or synthetics. The moisture-absorbing/insulating cover 56 is wrapped at least partially around the cooling mechanism 48. Desirably, the moisture-absorbing/insulating cover 56 surrounds at least 80% of the cooling mechanism 48. More desirably, the moisture-absorbing/insulating cover 56 surrounds at least 90% of the cooling mechanism 48. Even more desirably, the moisture-absorbing/insulating cover 56 surrounds at least 95% of the cooling mechanism 48. Most desirably, the moisture-absorbing/insulating cover 56 surrounds the entire cooling mechanism 48. The moisture-absorbing/insulating cover 56 functions to insulate the cooling mechanism 48 such that it stays cold longer. Most importantly, the moisture-absorbing/insulating cover 56 absorbs the condensation as the frozen liquid (ice) in the cooling mechanism 48 warms and changes back from a solid to a liquid keeping the lunch tote 10 and its contents dry. By "condensation" it is meant the state of being condensed; the process by which ice melts into a liquid.

As depicted in FIGS. 3, 11 and 12, the moisture-absorbing/insulating cover 56 is a rectangular, hollow member having a lower surface 58. The lower surface 58 can have an opening 60 formed therein, see FIG. 11. The opening 60 is shown as being rectangular but could be formed into some other shape, if desired. The opening 60 is sized to allow the cooling mechanism 48 to be easily inserted into the hollow moisture-absorbing/insulating cover 56. It should be understood that the moisture-absorbing/insulating cover 56 can vary in size and shape. Likewise, the opening 60 could be closed by the lower surface 58 of the moisture-absorbing/insulating cover 56. Alternatively, the lower surface 58 could overlap itself to close the opening 60. In normal use, the cooling mechanism 48 is placed in the freezer portion of a refrigerator or in a conventional freezer such that the liquid can freeze into a solid. The cooling mechanism 48 is then removed from the freezer portion of a refrigerator or from a conventional freezer and is inserted into the moisture-absorbing/insulating cover 56. The cooling mechanism 48 and the moisture-absorbing/insulating cover 56 are then inserted into the pocket 44 of the lunch tote 10.

As shown in FIGS. 11 and 12, the moisture-absorbing/insulating cover 56 contacts the intermediate layer 43.

Referring again to FIG. 6, the cooling mechanism 48 has a longitudinal central axis $X_1$-$X_1$ and a vertical central axis $Y_1$-$Y_1$. The cooling mechanism 48 also has a first portion 62, a second portion 64, and a third portion 66. The second portion 64 is located horizontally between the first and third portions, 62 and 66 respectively. The first portion 62 is located adjacent to the first end 32 of the outer cover 24, and the third portion 66 is located adjacent to the second end 34 of the outer cover 24 when the cooling mechanism 48 is inserted into the pocket 44 of the lunch tote 10. Attached or secured to the bottom layer 50 of the second portion 64 of the cooling mechanism 48 is a rigid member 68. The rigid member 68 is formed from a non-flexible material. The rigid member 68 can be formed from various materials. Typically, the rigid member 68 is formed from a low cost material, such as a plastic or thermoplastic material, or from some other material known to those skilled in the art. The function of the rigid member 68 is to create a floor or base in the lunch tote 10. This floor or base will allow the lunch tote 10 to stand upright by itself, when in the closed orientation. The rigid member 68 allows the lunch tote 10 to stand upright even when no food items or drinking container is contained in the lunch tote 10. In other words, the floor or base created by the rigid member 68 provides structure to the lunch tote 10 such that it resembles a common lunch box formed of tin, metal or aluminum.

The rigid member 68 should be formed from a material which is not adverse to changes in temperatures ranging from between about 0° Fahrenheit (F) to about 100° F. Desirably, the rigid member 68 will not crack, break, chip or become deformed by changes in temperature. The reason why the rigid member 68 should not be affected by changes in temperature, is that the rigid member 68 is attached or secured to the bottom layer 50 of the cooling mechanism 48 and will remain with the cooling mechanism 48 when it is placed in the freezer portion of a refrigerator or in a conventional freezer.

Still referring to FIG. 6, the rigid member 68 has a thickness $t_4$ which can vary in dimension. Desirably, the rigid member 68 has a thickness $t_4$ which ranges from between about 0.05 inches to about 0.25 inches. More desirably, the rigid member 68 has a thickness $t_4$ of less than about 0.2 inches. Even more desirably, the rigid member 68 has a thickness $t_4$ of less than about 0.18 inches. Most desirably, the rigid member 68 has a thickness $t_4$ of less than about 0.15 inches.

The rigid member 68 can be attached or secured to the cooling mechanism 48 in a number of ways. For example, the rigid member 68 can be secured to the cooling mechanism 48 by a mechanical fastener 70. The mechanical fastener 70 can be one or more plastic tie strips, wire, Velcro® strap, hook and loop straps, snap fittings, etc. Alternatively, the rigid member 68 can be attached or secured to the cooling mechanism 48 using an adhesive, a co-adhesive, an ultrasonic bond, a heat seal, a pressure seal, a combination heat and pressure seal, or in some other fashion known to those skilled in the art. The attachment must be secure since the rigid member 68 will go through a number of temperature changes as the cooling mechanism 48 is frozen and then thaws out.

Referring again to FIGS. 4 and 6, the mechanical fastener 70 is depicted as a plastic tie strip which can be cinched into a loop by a locking mechanism 72, see FIG. 6. Two spaced apart mechanical fasteners 70, 70, in the form of plastic tie strips, are used to secure the rigid member 68 to the cooling mechanism in FIGS. 4 and 6. Such plastic tie strips are commercially available at most hardware stores.

Referring again to FIGS. 3, 4 and 6, the cooling mechanism 48 further has a first living hinge 74 and a second living hinge 76. The first living hinge 74 is located between the first and second portions, 62 and 64 respectively, of the cooling mechanism 48, and the second living hinge 76 is located between the second and third portions, 64 and 66 respectively, of the cooling mechanism 48. The cooling mechanism 48 can bend or fold along each of the first and second living hinges, 74 and 76 respectively. The ability of the cooling mechanism 48 to fold allows it to extend from the bottom 16 into the front 12 and back 14 of the lunch tote 10. By allowing the cooling mechanism 48 to extend over such a large surface area assures that the food items and the drink container stored therein will be kept cool for an extended period of time.

Referring now to FIGS. 1-3, 7, 8 and 10, a closure mechanism 78 is shown secured to a major portion of the distal edge 38 of the sidewall 36. The closure mechanism 78 can be a zipper. By "zipper" it is meant a fastening device consisting of parallel rows of metal, plastic, or nylon teeth on adjacent edges of an opening that are interlocked by a sliding tab. The closure mechanism 78 can be a metal zipper, a plastic zipper, a nylon zipper, or be a zipper made out of any other material known to those skilled in the art. The closure mechanism 78 is movable from a closed position, wherein the lunch tote 10 is a closed container, to an open position, wherein the entire lunch tote 10 is convertible into a serving tray 10'. The closure mechanism 78 also includes a sliding tab 80 which allows the teeth of the zipper to interlock. A small pocket 82, see FIG. 1, covers the terminal end of the closure mechanism 78 (zipper) and keeps it from unraveling. The small pocket 82 also provides decoration where that portion of the closure mechanism 78 extends beyond the lunch tote 10.

Referring now to FIGS. 2, 3, 7, 8 and 10, one can clearly see that the sidewall 36 contains a first inwardly projecting portion 84 and a second inwardly projecting portion 86. Both of the first and second inwardly projecting portions, 84 and 86 respectively, are located along the vertical central axis Y-Y of the outer cover 24. Each of the first and second inwardly projecting portions, 84 and 86 respectively, can be formed by making a pair of tucks 88 and 90 on either side thereof. Each of the pair of tucks 88 and 90 is horizontally situated to the left and right of each of the first and second inwardly projecting portions, 84 and 86 respectively. One cannot see the pair of tucks 88 and 90 associated with the first inwardly projecting portion 84 simply because of the arrangement of the perspective view. However, a pair of tucks 88 and 90 is associated with each of the first and second inwardly projecting portions, 84 and 86 respectively. By "tuck" it is meant to gather up and fold or turn in so as to secure or confine. The pair of tucks 88 and 90 function to permit the first and second inwardly projecting portions, 84 and 86 respectively, to assume a vertical orientation as the lunch tote 10 transitions from a closed position to an open position, and from a vertical to a horizontal orientation when the lunch tote 10 transitions back to a closed position. During this transition, the pair of tucks 88 and 90 will move from a horizontal orientation to a vertical orientation. When the lunch tote 10 has transitioned to the open position (the serving tray 10'), the first and second inwardly projecting portions, 84 and 86 respectively, will have moved slightly outward to form a portion of the upstanding sidewall 36.

Furthermore, the pair of tucks 88 and 90 function to permit the first and second inwardly projecting portions, 84 and 86 respectively, to fold inward as the lunch tote 10 is moved from the open position back to the closed position. During this transition, the pair of tucks 88 and 90 will move from a vertical orientation to a horizontal orientation and will become coaxially aligned relative to one another.

Referring again to FIGS. 2, 3, 7 and 8, one will also notice that the closure mechanism 78 (zipper) is spaced apart from the first inwardly projecting portion 84 by an opening 92. The size of the opening 92 can vary. The opening 92 is hidden when the closure mechanism 78 is closed and the lunch tote 10 is in its closed orientation. One can also see that no such opening is formed adjacent to the second inwardly projecting portion 86. The reason for this is that the closure mechanism 78 (zipper) does not extend over or across the second inwardly projecting portion 86. In other words, the second inwardly projecting portion 86 is free of the closure mechanism 78 (zipper).

Referring again to FIGS. 1, 2, 3, 7, 8 and 10, the lunch tote 10 also includes a pair of handles 94 and 96. Each of the pair of handles 94 and 96 extends outward from the outer cover 24. One of the pair of handles 94 is located approximate the second end 34 of the outer cover 24, and a second of the pair of handles 96 is located approximate the first end 32 of the outer cover 24. The size and shape of the pair of handles 94 and 96 can vary. Typically, each of the pair of handles 94 and 96 are mirror images of each other.

It should be understood that the outer cover 24, the sidewall 36, the liner 40, the insulating layer 41, the closure mechanism 78, and the pair of handles 94 and 96 can be constructed such that they are machine washable and dryable.

Figure 9:
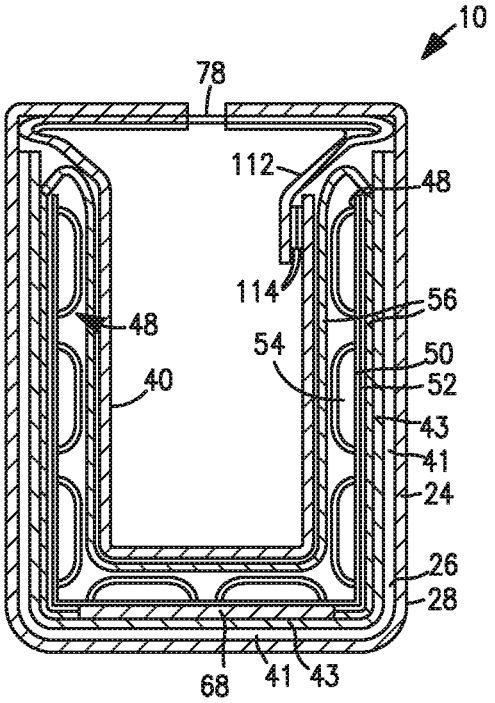
FIG. 9 is a cross-sectional view of the lunch tote taken along line 9-9 of FIG. 1.

Referring to FIG. 9, the lunch tote 10 is shown standing upright due to the presence of the rigid member 68. In this view, one can clearly see that the cooling mechanism 48 extends over at least about 70% of the inner circumference of the lunch tote 10. Desirably, the cooling mechanism 48 extends over at least about 75% of the inner circumference of the lunch tote 10. More desirably, the cooling mechanism 48 extends over at least about 80% of the inner circumference of the lunch tote 10. Most desirably, the cooling mechanism 48 extends over at least about 85% of the inner circumference of the lunch tote 10. The presence of the cooling mechanism 48 extending over such a large surface area ensures that the food items and drink container housed in the lunch tote 10 will remain chilled for an extended period of time.

Referring again to FIGS. 2, 3, 8 and 10, the liner 40 located inside the lunch tote 10 includes a sleeve 98. By "sleeve" it is meant a case into which at least a portion of an object, item or a device fits or is retained. The sleeve 98 can be sewn or stitched to the liner 40. The sleeve 98 can be open at opposite ends. The sleeve 98 has a pair of spaced apart casings 100 and 102, each of which contains at least one elastic strand, 104 and 106 respectively. The pair of casings 100 and 102 creates an elasticized sleeve 98 with stretchable portions. The sleeve 98 functions to securely hold a fruit, such as an apple, orange, peach, etc., therein. Alternatively, a thermos, a drink container, a juice box, a can of soda or a bottle of water, could also be retained in the sleeve 98.

The liner 40 also has at least two spaced apart loops 108, 108 aligned along a common centerline. A pair of loops 108, 108 is shown in the Figures. The pair of loops 108, 108 is spaced away from the sleeve 98. As depicted in FIG. 2, the pair of loops 108, 108 is spaced adjacent to the first end 32 of the outer cover 24 while the sleeve 98 is positioned adjacent to the second end 34 of the outer cover 24. The pair of loops 108, 108 can be used to secure one or more articles 110 therebetween. The articles 110 can be kitchen utensils, such as a knife, a fork, a spoon, etc. The article(s) 110 can also be one or more napkins, a bottle opener, another food item, etc.

It should be obvious from FIG. 2 that the sleeve 98 is positioned away from the at least two spaced apart loops 108, 108.

Figure 10:
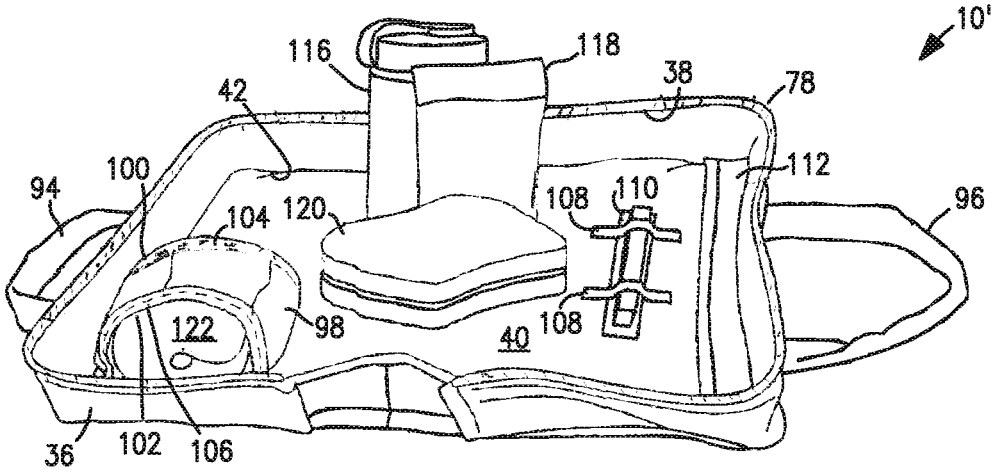
FIG. 10 is a perspective view of the lunch tote in an open orientation wherein it functions as a serving tray.

Referring to FIG. 10, the serving tray 10' depicts a drink container 116 and common lunch food items, such as a bag of chips 118, a sandwich 120, and a fruit 122, such as an apple. The articles 110 can be some other type of food item, such as a stick of cheese, a bread stick, etc. The fruit 122, such as an apple, can be secured in the sleeve 98.

Referring again to FIGS. 2, 3, 8, 11 and 12, the lunch tote 10 further includes a flap 112 secured to the interior surface 26 of the outer cover 24. The flap 112 can be constructed out of the same material as the liner 40. The flap 112 includes one or more fasteners 114. A pair of fasteners 114, 114 is shown in FIG. 2. The one or more fasteners 114, 114 can vary in construction. The one or more fasteners 114, 114 can be hook and loop fasteners, Velcro® fasteners, mechanical fasteners, a snap button, magnets, etc. The one or more fasteners 114, 114 secure the flap 112 to the liner 40 so that it closes off the opening 46. When the flap 112 is open, the cooling mechanism 48 and its surrounding moisture-absorbing/insulating cover 56 can be slid into the pocket 44. The flap 112 is then closed by the one or more fasteners 114, 114 and the cooling mechanism 48 and the moisture-absorbing/insulating cover 56 are securely held in place.

It should be understood that the opening 46 and its associated flap 112 could be situated 90° away from the second end 34 such that the opening 46 is aligned along the vertical central axis Y-Y of the outer cover 24. Likewise, the opening 46 could be located adjacent to the first end 34, if desired.

METHOD

A method of using the lunch tote 10, starting from the closed orientation shown in FIG. 1, will now be explained. The closure mechanism 78 is opened or unzipped and the lunch tote 10 is opened to its open orientation 10' as shown in FIG. 2. In this position, a frozen cooling mechanism 48 can be wrapped in the moisture-absorbing/insulating cover 56 and both can be inserted through the opening 46. The flap 112 is then secured to the liner 40 using the one or more fasteners 114, 114.

Next, the user can insert food items, such as a bag of chips 118, a sandwich 120, a piece of fruit 122, and a thermos, a drink container 116, such as a can of soda or a bottle of water, into the lunch tote 10. Other articles 110, such as eating utensils, one or more napkins, a bottle opener, or any combination of the aforementioned, can also be inserted into the lunch tote 10. Fruit, such as an apple, orange or peach can be positioned in the sleeve 98. The sleeve 98 will hold this item secure so that it will not roll around and get bruised or damaged. In addition, the sleeve 98 can protect soft food items, such as a sandwich 120, located adjacent to sleeve 98 from getting smashed or squashed, since the sleeve 98 will retain the piece of fruit up and away from the sandwich 120, when the lunch tote 10 is in a closed position.

Eating utensils can be secured by the pair of loops 108, 108. A sandwich 120, cup of fruit or vegetables, a bag of chips 118, etc. can be inserted into the lunch tote 10 adjacent to the sleeve 98. The closure mechanism 78 is then moved or zipped to a closed position wherein the lunch tote 10 is in a closed position, see FIG. 1. The user can then carry or transport the lunch tote 10 by grasping the pair of handles 94 and 96. The lunch tote 10 can be stored in a locker, under a desk, in a cabinet, etc. until lunch time. At this time, the user can retrieve the lunch tote 10 and perhaps take it to a cafeteria or picnic table.

The user can open the lunch tote 10 by moving the closure mechanism 78 (zipper) from its closed position to an open position, which converts the lunch tote 10 into a serving tray 10', see FIG. 10. As this occurs, the first and second inwardly projecting portions, 84 and 86 respectively, of the sidewall 36, because of the presence of the pair of tucks 88 and 90 situated on opposite sides of each of the first and second inwardly projecting portions, 84 and 86 respectively, permit the sidewall 36 to assume a vertical orientation as the lunch tote 10 transitions from a closed position to an open position. The pair of tucks 88 and 90 also allow the sidewall 36 to move from a vertical orientation to a horizontal orientation when the lunch tote 10 transitions back to a closed position.

The serving tray 10' will confine the items and form a barrier away from any contamination, such as a spilled liquid, a dirty table top, etc. Upon finishing his or her lunch, the user can discard any uneaten food items and/or unfinished drink. An empty thermos, an empty water bottle or an empty soda container can be retained in the lunch tote 10 before it is closed. These items can be taken home and be reused, be refilled or be recycled. Once the closure mechanism 78 is again moved to the closed position, the lunch tote 10 is ready to be carried off.

The lunch tote 10 can be washed and dried such that the interior and exterior surfaces, 26 and 28 respectively, will remain clean. The entire lunch tote 10, except for the cooling mechanism 48, can be machine washed and dried. This will assure that the lunch tote 10 remains clean and any food items placed in the lunch tote 10 will not become contaminated.

While the invention has been described in conjunction with a specific embodiment, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A lunch tote for storing food, comprising:

a) an outer cover having an interior surface, an exterior surface, and a perimeter, and said outer cover having a first end and a second end;

b) a sidewall extending upward from said perimeter, said sidewall having a distal edge;

c) a liner having an outer perimeter of which a portion is attached to said interior surface of said outer cover to form a pocket, a portion of said outer perimeter being free from said interior surface of said outer cover to form an opening into said pocket;

d) a cooling mechanism positioned in said pocket;

e) an intermediate layer positioned below said cooling mechanism;

f) a first insulating layer positioned between said interior surface of said outer cover and said intermediate layer;

g) a closure mechanism secured to a major portion of said distal edge of said sidewall, said closure mechanism being movable from a closed orientation, wherein said lunch tote is a closed container, to an open orientation, wherein said entire lunch tote is convertible into a serving tray; and h) a pair of handles extending outward from said outer cover, one of said pair of handles located approximate said first end, and a second of said pair of handles located approximate said second end.

2. The lunch tote of claim 1 wherein said cooling mechanism is an ice pack which is at least partially surrounded by a moisture-absorbing/insulating cover, and said cooling mechanism extends over at least about 70% of an inner circumference of said lunch tote.

3. The lunch tote of claim 2 wherein said ice pack comprises a first portion, a second portion, and a third portion, and said second portion has a rigid member secured thereto, and said first portion is located adjacent to said first end of said outer cover and said third portion is located adjacent to said second end of said outer cover.

4. The lunch tote of claim 3 wherein said ice pack comprises a first living hinge located between said first and second portions, and a second living hinge located between said second and third portions.

5. The lunch tote of claim 3 wherein said lunch tote, without said cooling mechanism, is machine washable and dryable.

6. The lunch tote of claim 3 wherein said rigid member is formed from a material which is not adverse to temperatures from between 0° Fahrenheit and 100° Fahrenheit.

7. The lunch tote of claim 1 wherein said outer cover has a longitudinal central axis and a vertical central axis, said sidewall contains first and second inwardly projecting portions located along said vertical central axis, and said closure mechanism is a zipper which is spaced apart from said first inwardly projecting portion by an opening.

8. The lunch tote of claim 7 wherein said second inwardly projecting portion is free of said zipper.

9. The lunch tote of claim 1 wherein said sidewall comprises first and second inwardly projecting portions and a pair of tucks associated with each of said first and second inwardly projecting portions, said pair of tucks situated on opposite sides of each of said first and second inwardly projecting portions, and said pair of tucks permitting said sidewall to move to a vertical orientation when said lunch tote transitions from a closed position to an open position, and from a vertical to a horizontal orientation when said lunch tote transitions back to a closed position.

10. A lunch tote for storing food, comprising:

a) an outer cover having an interior surface, an exterior surface, and a perimeter, and said outer cover having a first end and a second end;

b) a sidewall extending upward from said perimeter, said sidewall having a distal edge, and said sidewall containing first and second inwardly projecting portions;

c) a liner having an outer perimeter of which a portion is attached to said interior surface to form a pocket, a portion of said outer perimeter being free from said interior surface to form an opening into said pocket;

d) a cooling mechanism positioned in said pocket, said cooling mechanism having a first portion, a second portion, and a third portion, and said second portion having a rigid member secured thereto;

e) an intermediate layer positioned below said cooling mechanism;

f) an insulating layer positioned between said interior surface of said outer cover and said intermediate layer;

g) a closure mechanism secured to a major portion of said distal edge of said sidewall, said closure mechanism being movable from a closed orientation, wherein said lunch tote is a closed container, to an open orientation, wherein said entire lunch tote is convertible into a serving tray; and said closure mechanism being spaced apart from said first inwardly projecting portion and terminating on either side of said second inwardly projecting portion; and h) a pair of handles extending outward from said outer cover, one of said pair of handles located approximate said first end, and a second of said pair of handles located approximate said second end.

11. The lunch tote of claim 10 wherein said cooling mechanism is an ice pack which is at least partially surrounded by a moisture-absorbing/insulating cover, and said cooling mechanism extends over at least about 75% of an inner circumference of said lunch tote, said sidewall has a height which ranges from between about 1 inch to about 2 inches, and said sidewall is formed from a flexible fabric.

12. The lunch tote of claim 10 wherein said cooling mechanism comprises a bottom layer joined to a top layer, and at least one cavity is formed in said top layer, a liquid is contained within said at least one cavity, and said liquid is capable of freezing into a solid.

13. The lunch tote of claim 10 wherein said rigid member is secured to said second portion of said cooling mechanism, and said rigid member permits said lunch tote to stand upright when said lunch tote is in said closed position.

14. The lunch tote of claim 10 wherein said sidewall comprises first and second inwardly projecting portions and a pair of tucks associated with each of said first and second inwardly projecting portions, said pair of tucks situated on opposite sides of each of said first and second inwardly projecting portions, and said pair of tucks permitting said sidewall to move to a vertical orientation when said lunch tote transitions from a closed position to an open position, and from a vertical to a horizontal orientation when said lunch tote transitions back to a closed position.

15. The lunch tote of claim 10 wherein said liner has an elasticized sleeve secured thereto, and said liner also has at least two spaced apart loops aligned along a common centerline for securing one or more articles therebetween.

16. A lunch tote for storing food, comprising:

a) an outer cover having an interior surface, an exterior surface, and a perimeter, and said outer cover having a first end and a second end;

b) a sidewall extending upward from said perimeter, said sidewall having a distal edge, and said sidewall containing first and second inwardly projecting portions;

c) a liner having an outer perimeter of which a portion is attached to said interior surface to form a pocket, a portion of said outer perimeter being free from said interior surface to form an opening into said pocket, and said liner having at least two spaced apart loops aligned along a common centerline for securing one or more articles therebetween, and a sleeve positioned away from said at least two spaced apart loops for retaining an item;

d) a cooling mechanism positioned in said pocket, said cooling mechanism having a first portion, a second portion, and a third portion, and said second portion having a rigid member secured thereto;

e) an intermediate layer positioned below said cooling mechanism;

f) a first insulating layer positioned between said interior surface of said outer cover and said intermediate layer;

g) a closure mechanism secured to a major portion of said distal edge of said sidewall, said closure mechanism being movable from a closed orientation, wherein said lunch tote is a closed container, to an open orientation, wherein said entire lunch tote is convertible into a serving tray; and h) a pair of handles extending outward from said outer cover, one of said pair of handles located approximate said first end, and a second of said pair of handles located approximate said second end.

17. The lunch tote of claim 16 wherein a second insulating layer is positioned in said sidewall.

18. The lunch tote of claim 16 wherein said cooling mechanism comprises a first living hinge located between said first and second portions, and a second living hinge located between said second and third portions, and said rigid member is mechanically fastened to said second portion by at least one plastic tie strip.

19. The lunch tote of claim 16 wherein said rigid member is formed from a non-flexible material, and said rigid member has a thickness ranging from between about 0.05 inches to about 0.25 inches.

20. The lunch tote of claim 16 wherein said sidewall comprises first and second inwardly projecting portions and a pair of tucks associated with each of said first and second inwardly projecting portions, said pair of tucks situated on opposite sides of each of said first and second inwardly projecting portions, and said pair of tucks permitting said sidewall to move to a vertical orientation when said lunch tote transitions from a closed position to an open position, and from a vertical to a horizontal orientation when said lunch tote transitions back to a closed position.

* * * * *